US006474498B1

(12) United States Patent
Markham

(10) Patent No.: US 6,474,498 B1
(45) **Date of Patent: *Nov. 5, 2002**

(54) THERMALLY INSULATED CONTAINERS FOR LIQUIDS

(76) Inventor: Gary R. Markham, Orchard Lea Playhatch, Oxfordshire RG4 9OU (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/071,763

(22) Filed: May 1, 1998

(30) Foreign Application Priority Data

Feb. 6, 1998 (GB) ..... 9802456

(51) Int. Cl.[7] ..... F25D 23/00

(52) U.S. Cl. ..... 220/592.01; 220/62.12; 220/62.22; 220/592.09; 220/592.16; 220/906

(58) Field of Search ..... 220/592.15, 592.16, 220/592.17, 592.2, 592.23, 592.25, 906, 62.12, 62.22, 592.01, 592.09, 592.11

(56) References Cited

U.S. PATENT DOCUMENTS 2,092,296 A * 9/1937 Voorhees ..... 220/906 X
2,117,180 A * 5/1938 Kronquest ..... 220/906 X
2,221,310 A * 11/1940 Gazelle ..... 428/158
2,229,343 A * 1/1941 Saunders et al. ..... 428/467
2,311,308 A * 2/1943 Thomas et al. ..... 220/562
2,832,964 A * 5/1958 Se Breny ..... 220/592.01 X
2,853,222 A * 9/1958 Gallagher ..... 229/402
2,917,217 A * 12/1959 Sisson ..... 138/103
3,220,595 A * 11/1965 Edwards ..... 220/62.12
3,589,592 A * 6/1971 Tigner ..... 220/592.17
3,618,807 A * 11/1971 Rowand ..... 220/592.17 X
3,913,770 A * 10/1975 Tarro ..... 215/223
4,889,252 A 12/1989 Rockom et al.
4,981,234 A * 1/1991 Slaughter ..... 62/457.1
5,329,778 A * 7/1994 Padamsee ..... 220/592.16 X
5,638,979 A 6/1997 Shea
5,988,493 A * 11/1999 Clougherty ..... 229/164

FOREIGN PATENT DOCUMENTS

GB 506808 * 6/1939 ..... 220/906
WO WO 85/01641 4/1985

* cited by examiner

*Primary Examiner*—Lee Young
*Assistant Examiner*—Joseph C Merek
(74) *Attorney, Agent, or Firm*—Fitch, Even, Tabin & Flannery

(57) ABSTRACT

Containers for liquids, commonly dispensed for consumption at a temperature below ambient (such as chilled soft drinks cans) can be maintained for extended periods below ambient, after they have been dispensed from a refrigerated container, by providing a lining member formed from a plastics material having closed cells and providing insulating properties. The lining member may, for instance, have large cells and be dimensioned to fit within the shell of the container, or can be formed as a layer on the internal surface of the shell of the container.

8 Claims, 2 Drawing Sheets

THERMALLY INSULATED CONTAINERS FOR LIQUIDS

This invention relates to the thermal insulation of containers for liquids. More specifically, it relates to means for keeping containers for potable liquids at a temperature below ambient. Potable liquids, such as soft drinks and beer, are commonly sold for consumption in thin walled metal cans. These are normally dispensed from refrigerated containers, or may be stored in a domestic refrigerator, but once they have been delivered to the person intending to drink them, the temperature will rapidly tend towards ambient temperature, because the metal from which they are formed will have a high thermal conductivity, as well as being too thin to act as a heat sink in itself.

Insulating means, such as a bag with a drawstring at the neck, are known for keeping cans or wine bottles cool when they are being carried, such as in a haversack or a basket. Also, some external cooling for wine bottles can be provided by a cylindrical jacket of a size to fit tightly over a wine bottle. This jacket can be chilled in the freezer section of a refrigerator and applied over the single bottles for keeping them cool over a short period. Such devices have certain practical shortcomings, however. Although they can be used for carrying cans or bottles before they are opened, they are less useful once the container has been opened, especially a can of the ring-pull type. There will also be a hygiene problem with spillage, which can lead to the inconvenience involved in laundering the container. Moreover, such containers are too expensive for disposable use.

The present invention relates to a container for liquids, said container comprising a shell (preferably formed from a metal) for containing the liquids, wherein the container is provided with a lining member formed from a plastics material having closed cells and providing thermal insulation properties.

In one embodiment, the container can be provided with a means for opening, and then resealing, such as a screw cap.

In another embodiment, the container can be operable but without means for resealing it; such a container could be a ring-pull can.

According to one embodiment of the invention, the lining member is provided by a closed cell member having such dimensions as to fit within the shell and in contact with the internal walls of the shell. For instance, in a ring-pull can, such as is conventionally used for soft drinks, beer, etc., the lining member may be substantially cylindrical, and adapted to provide a slidable fit within the shell so as to be in contact with the cylindrical interior of the shell wall. If desired, this lining member may have an adherent surface to enable the member to adhere to the wall of the can. Such a lining member may be formed from a plastics material having large cells, containing a gas, the material being similar to the wrapping material commonly known as bubble wrap.

In an alternative embodiment, a closed cell material can be provided as a layer on the intended-interior surface of the metal to be used to form the can, in addition to or in place of the conventional lacquer coating applied to the intended interior wall of the can.

Figure 1:
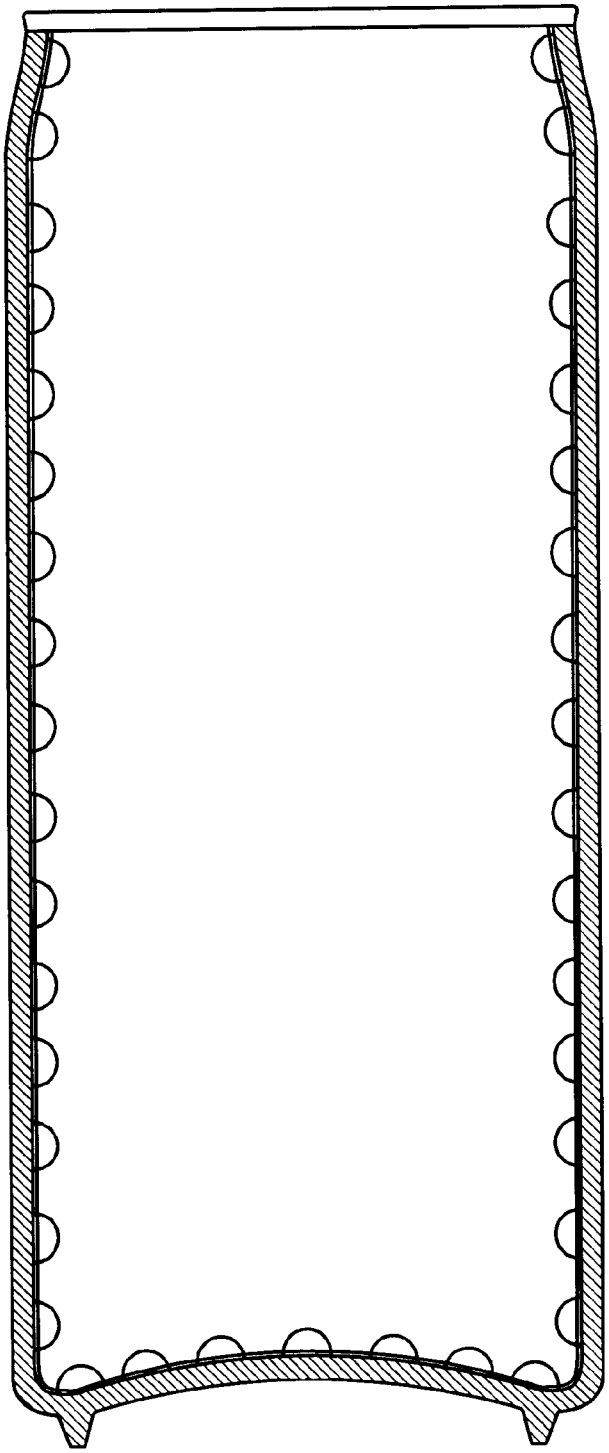
FIG. 1 is a cut away view of a container for liquids.
Figure 2:
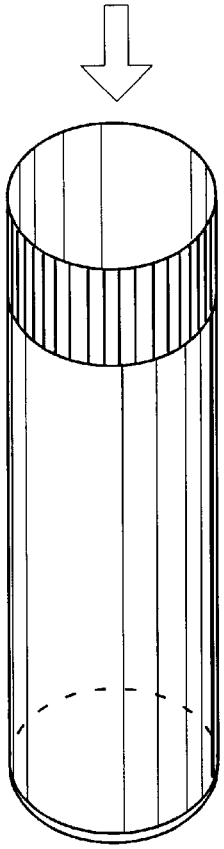
FIG. 2 is a perspective view of a shell and liner.
Figure 3:
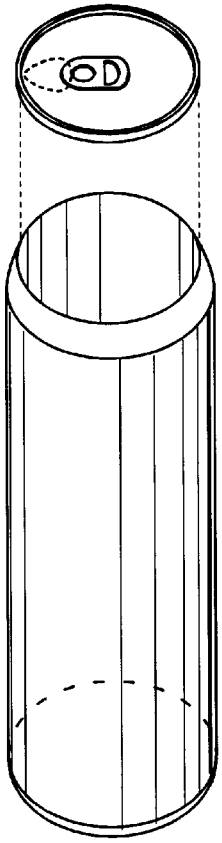
FIG. 3 is a perspective view of the shell and an unattached closure.
Figure 4:
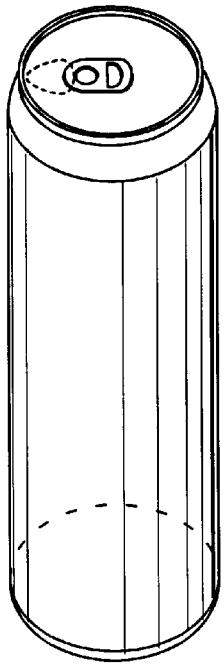
FIG. 4 is a perspective view of a completed can.

Whether the thermal insulation is provided by a separate lining member, or as a layer provided on the metal wall before manufacture of a can, it should be formed from a material that is inert with respect to the intended contents of the container. It should not be formed from or include any material that is soluble in the liquid contents, or would be in any way reactive with them, either chemically or biologically. The nature of suitable materials, for instance polymeric materials, will be well known to those skilled in the art.

A container, such as described above, will have positive advantages when compared with a conventional container, such as a can.

Because of the insulation provided by the lining member used according to the invention, the container will take a significantly longer time to reach ambient temperature once it is dispensed from refrigerated storage at the point of sale. This will have the advantage of keeping a beverage in a more palatable state. In addition, an aerated beverage loses effervescence on warming, and thus becomes less palatable, so that maintaining a temperature below ambient will assist in maintaining the liquid in a palatable state.

Although the invention has been described specifically with relation to containers for beverages, it can also be applied to other containers where it is desirable that the temperature should be restrained from approaching ambient temperature for as long as possible a period, after it is removed from storage and before use. Such containers may for instance be intended for emergency medical use, such as for containing pharmaceutical materials for injection or oral administration.

What is claimed is:

1. A container for liquids comprising:

a metal shell having a substantially cylindrical shape with two closed ends for containing such liquids, a lining member within the shell for contacting said liquids, said lining member being inert with respect to a predetermined liquid and being formed from a closed cell plastics material providing thermal insulation properties and having such dimensions as to fit within the shell and in contact with the walls of the shell, the lining member comprising bubble wrap.

2. A container according to claim 1 wherein the lining member is disposed as a layer on an internal wall of the shell.

3. A container according to claim 1 comprising an adherent surface disposed on the lining member for adhering the lining member to an interior of the shell.

4. A beverage container comprising:

an exterior shell of thin walled metal, the exterior shell having a substantially cylindrical shape and two closed ends for containing the beverage; and a lining member adhered to an interior surface of the exterior shell for contacting the beverage, said lining member comprising a layer of closed cell plastics material having thermal insulating properties to impede the transfer of heat through the external shell and being substantially Inert with respect to the beverage, the lining member comprising bubble wrap.

5. A beverage container according to claim 4 wherein the lining member comprises a cylindrical liner of closed cell plastics material sized to fit within an interior of the exterior shell and having an adherent layer on an exterior surface for adhering to the interior of the exterior shell.

6. A beverage container according to claim 4 wherein the lining member comprises a layer of closed cell plastics material applied to the interior of the exterior shell.

7. A container according to claim 1 wherein the container comprises a beverage can having a pull ring opener.

8. A beverage container according to claim 4 comprising a pull ring opener.

* * * * *